US007624466B2

(12) United States Patent
Kim et al.

(10) Patent No.: US 7,624,466 B2
(45) Date of Patent: Dec. 1, 2009

(54) OPERATION METHOD OF LAUNDRY DEVICE

(75) Inventors: Young Soo Kim, Changwon-si (KR); Soung Bong Choi, Changwon-si (KR); Byung Hwan Ahn, Gimhae-si (KR); Deug Hee Lee, Gimhae-si (KR); Hung Myong Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 769 days.

(21) Appl. No.: 11/296,864

(22) Filed: Dec. 8, 2005

(65) Prior Publication Data

US 2006/0151009 A1 Jul. 13, 2006

(30) Foreign Application Priority Data

Dec. 9, 2004 (KR) ..... 10-2004-0103479

(51) Int. Cl.
*D06F 33/02* (2006.01)

(52) U.S. Cl. ..... 8/159

(58) Field of Classification Search ..... 134/184, 134/198; 8/148, 149; 68/15, 3 R
See application file for complete search history.

(56) References Cited

U.S. PATENT DOCUMENTS

| | | | | | |
|---|---|---|---|---|---|
| 1,852,179 | A | * | 4/1932 | McDonald | 68/183 |
| 2,566,488 | A | * | 9/1951 | Gould | 68/20 |
| 3,035,428 | A | * | 5/1962 | Curtis et al. | 68/18 F |
| 3,102,796 | A | * | 9/1963 | Erickson | 34/75 |
| 3,173,767 | A | * | 3/1965 | Perloff | 34/82 |
| 3,242,584 | A | * | 3/1966 | Jacobs | 34/448 |
| 3,402,477 | A | * | 9/1968 | Hubbard | 34/543 |
| 3,540,241 | A | * | 11/1970 | Jacobs | 68/12.15 |
| 3,555,701 | A | * | 1/1971 | Hubbard | 34/602 |
| 4,207,683 | A | * | 6/1980 | Horton | 34/60 |
| 4,510,778 | A | * | 4/1985 | Cotton | 68/12.15 |
| 4,663,538 | A | * | 5/1987 | Cotton et al. | 307/38 |
| 5,152,077 | A | * | 10/1992 | Liang | 34/77 |
| 5,444,996 | A | * | 8/1995 | Joslin et al. | 68/12.04 |
| 6,671,978 | B1 | * | 1/2004 | McGowan et al. | 34/596 |
| 6,928,752 | B2 | * | 8/2005 | Johnson et al. | 34/595 |
| 2002/0017117 | A1 | * | 2/2002 | Sunshine et al. | 68/3 R |
| 2003/0115682 | A1 | * | 6/2003 | Gardner | 8/159 |
| 2004/0118008 | A1 | * | 6/2004 | Jeong et al. | 34/425 |
| 2004/0154194 | A1 | | 8/2004 | Prows | |
| 2004/0194339 | A1 | | 10/2004 | Johnson et al. | |

FOREIGN PATENT DOCUMENTS

| | | | |
|---|---|---|---|
| DE | 3204718 | | 9/1982 |
| DE | 197 43 508 | * | 4/1999 |
| DE | 102005053702 | | 6/2006 |
| EP | 1441059 | | 7/2004 |
| GB | 2094961 A | | 9/1982 |
| JP | 61-128995 | * | 6/1986 |

(Continued)

*Primary Examiner*—Frankie L Stinson
(74) *Attorney, Agent, or Firm*—McKenna Long & Aldridge LLP

(57) ABSTRACT

The present invention relates to an operation method of a laundry device, and more particularly, to an operation of a new type of laundry device capable of performing a washing cycle and a drying cycle at the same time successively or simultaneously, as well as enabling the entire washing performed in high temperature environments for enhancing washing efficiency.

15 Claims, 7 Drawing Sheets

FOREIGN PATENT DOCUMENTS

| | | | |
|---|---|---|---|
| JP | 63-082700 | * | 4/1988 |
| JP | 05-293300 | * | 11/1993 |
| JP | 10-071294 | * | 3/1998 |
| JP | 2003-093775 | * | 4/2003 |
| KR | 2004045755 | * | 2/2004 |

* cited by examiner

OPERATION METHOD OF LAUNDRY DEVICE

This application claims priority to Korean Application P 2004-103479 filed on Dec. 9, 2004, which is incorporated by reference, as is fully set forth herein.

BACKGROUND OF THE INVENTION

1. Field of the Invention

The present invention relates to a laundry device, and more particularly, to a new type of laundry device which can perform a washing, a drying and a refreshing cycle successively or simultaneously.

2. Discussion of the Related Art

In general, laundry devices including washing machines and dryers are electric home appliances which can wash or dry cloth items, cloths and beddings (hereinafter, 'the laundry'). A dryer of the laundry devices used in a house usually dries a small amount of the laundry.

That is, the dryer receives the laundry washed by the washing machine, and dries the laundry by supplying hot air.

However, the related art dryer has a problem that drying for a tangled portion of the laundry is not dried smoothly, because the drying cycle is in process in a state of the laundry being introduced together at one time.

There is another problem that it is impossible to keep the laundry for a long time in the related art dryer.

Thus, recently demands have been increasing accordingly for a new type of a dryer having a drying capacity thereof enlarged as well as capable of keeping the laundry for a long time. There are various kinds of combination dryers provided with tumble dryers and auxiliary cabinet dryers therewith, for example, U.S. Laid-open Patent Application No. 2004-0194339 A1 or U.S. Laid-open Patent Application No. 2004-0154194 A1.

The above combination dryer allows a cabinet dryer provided on a top of a conventional dryer having a rotatory drum.

The cabinet dryer has space for the laundry and receives hot air used to dry or keep the laundry for a long time.

However, the related art combination dryer described above has an inconvenience that it performs only a drying cycle and keeping of the laundry, not a washing cycle.

That is, since an auxiliary washing machine should be provided for washing the laundry, a user should purchase a washing machine and a combination dryer separately. Thus, it is difficult to secure an installation space, and production cost may rise due to overlapping of some configurations.

Also, in a related art washing machine, it is possible to set up a washing temperature because of a great washing efficiency when washing the laundry at high temperature. However, for the great washing efficiency at a high washing temperature, an auxiliary heater should be needed to heat washing water. Thereby, the related art washing machine has a problem that production cost thereof may be raised.

SUMMARY OF THE INVENTION

Accordingly, the present invention is directed to an operation method of a laundry device that substantially obviates one or more problems due to limitations and disadvantages of the related art.

An object of the present invention is to provide a new type of a laundry device capable of performing a washing cycle and a drying cycle at the same time successively or simultaneously.

Another object of the present invention is to provide a new type of a laundry device enabling the entire washing performed in high temperature environments for enhancing washing efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an operation method of a laundry device comprising: a first step of performing a washing cycle by using a washing machine; a second step of moving the laundry into a cabinet dryer which selectively receives steam together with the washing machine; and a third step of performing a drying cycle by supplying hot air into the cabinet dryer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
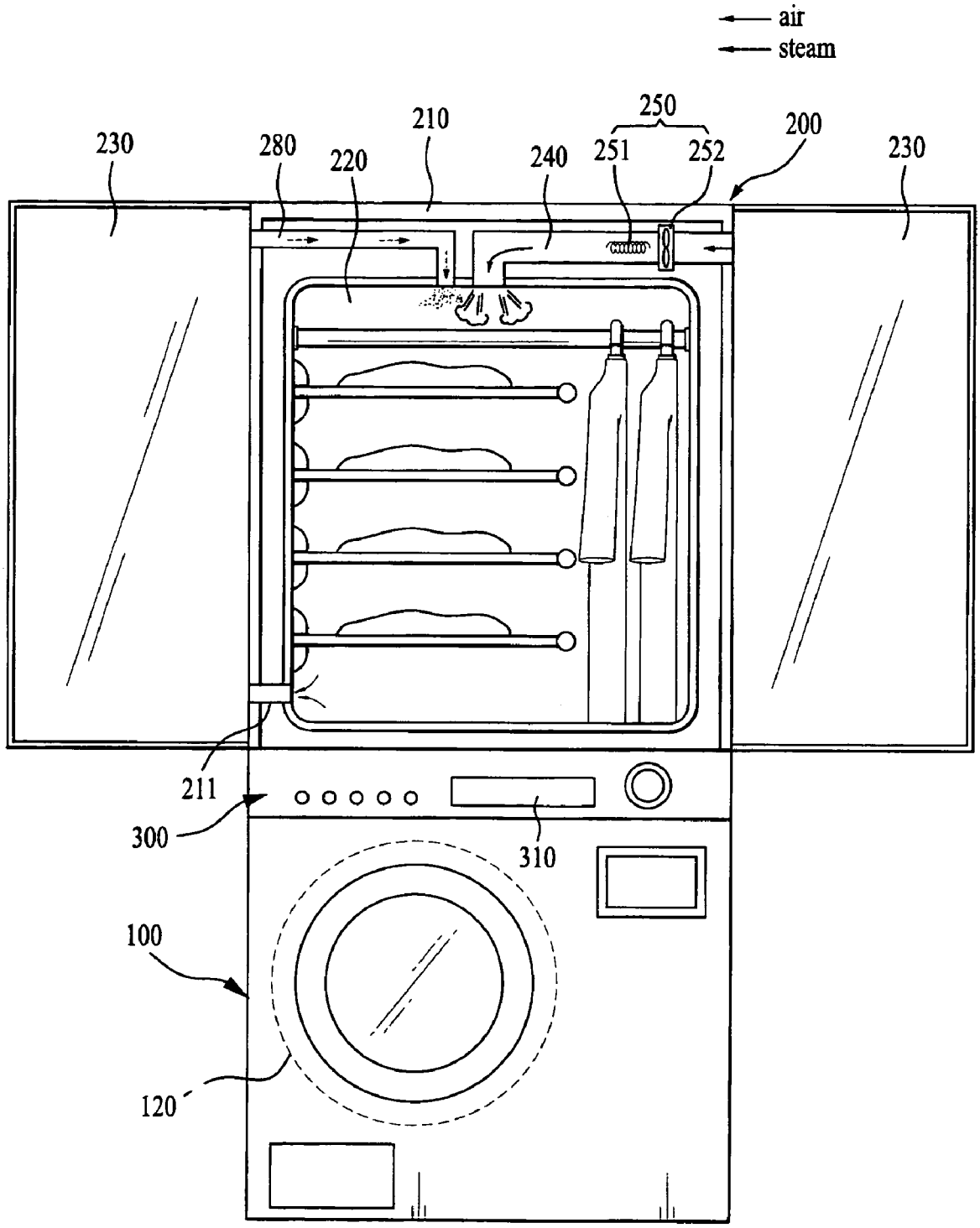
FIG. 1 is a diagram schematically illustrating an exterior of a laundry device according to embodiments of the present invention.
Figure 2:
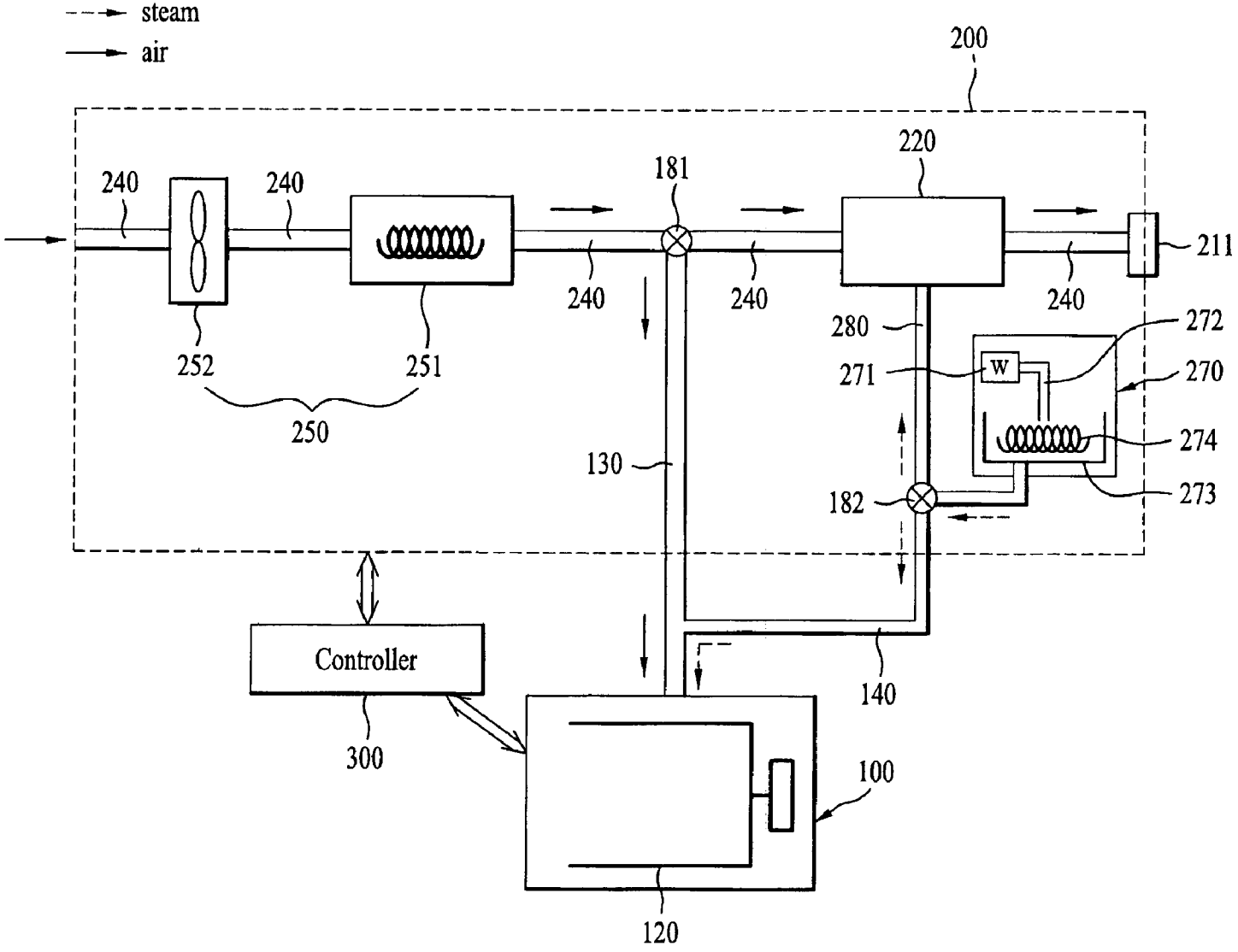
FIG. 2 is a block diagram schematically illustrating the laundry device according to the embodiments of the present invention.

A laundry device according to preferred embodiments of the present invention is illustrated in FIGS. 1 and 2.

That is, the laundry device according to the preferred embodiments of the present invention includes a washing machine 100, a cabinet dryer 200, and a controller 300.

Each of the above configurations will be described in detail.

First, the washing machine will be described.

The washing machine 100 performs a washing cycle, and includes a drum 120 capable of rotating and agitating.

Next, the cabinet dryer 200 will be described.

The cabinet dryer 200 according to the present invention performs a drying cycle for the laundry washed in the washing machine 100, and also performs a refreshing cycle and keeps the laundry for a long period of time.

The cabinet dryer 200 is mounted on a top of the washing machine 100 and includes a body 210, a keeping part 220, a door 230, a hot air supplying pipe 240, a hot air supplying part 250 and a steam generating part 270.

The body 210 defines an exterior of the cabinet dryer 200

The body 210 is formed in an opened box shape having a front thereof opened.

The keeping part 220 is inside space of the body 210 for keeping lots of the laundries therein.

The door 230 is provided in front of the body 210 for selectively opening/closing the opened front of the body 210.

The hot air supplying pipe 240 is an air passage for guiding high temperature hot air.

A first end of the hot air supplying pipe 240 is in communication with an outside the body 210 of the cabinet dryer 200, and a second thereof is in communication with an inside of the body.

At that time, the body 210 further includes a discharging part 211. the discharging part 211 is an opened portion for discharging humid air having dried the laundry within the laundry keeping space 220 to an outside of the body 210.

The discharging part 211 is in communication with a room (an outside of the body), and an auxiliary exhausting fan (not shown) may be provided in the discharging part 211.

The hot air supplying pipe 240 is provided along upper space of the cabinet dryer 200. Alternatively, the hot air supplying pipe 240 may be provided in downside space within the body 210 or side space within the body 210.

According to the preferred embodiments of the present invention, the hot air supplying pipe 240 is provided along an upper space within the body 210.

The hot air supplying part 250 is provided within the hot air supplying pipe 240 for heating air flowing within the hot air supplying pipe 240.

The hot air supplying part 250 includes a drying heater 251 for heating flowing air. Preferably, the hot air supplying part 250 further includes a fan 252 for forcibly ventilating air within the hot air supplying pipe 240.

Preferably, the fan 252 is provided at an air inlet of the drying heater 251 within the hot air supplying pipe 240.

That is, the fan 252 drives for forcibly drawing external dry air to pass through the drying heater 251.

Alternatively, the fan 252 may be provided at an air outlet of the drying heater 251 within the hot air supplying pipe 240, but in that case, a fan motor (not shown) driving the fan 252 may be damaged by the hot heat. Therefore, it is not preferred.

On the other hand, it is preferred but not necessary to supply hot air generated by the operation of the hot air supplying part 250 to the washing machine 100, too. Hence, according to the first embodiment of the present invention, a first connecting pipe 130 is further provided in the washing machine 100 for being connected with the hot air supplying pipe 240 of the cabinet dryer 200.

That is, the hot air flowing through the hot air supplying pipe 240 may be supplied to the washing machine 100 through the first connecting pipe 130.

The high temperature hot air is used so that a temperature of the washing machine 100 may be high enough to separate dirt from the laundry. Thus, the hot air enables the laundry washed within the washing machine to be dried.

Furthermore, a first air channel valve 181 may be provided at a connection portion between the first connecting pipe 130 and the hot air supplying pipe 240.

Preferably, the first air channel valve 181 is a 3-way valve selectively opening/closing the first connecting pipe 130 and the hot air supplying pipe 240.

Alternatively, the first air channel valve 181 may be a valve capable of adjusting an amount of an air inflow.

Also, the first air channel valve 181 may provided each in the first connecting pipe 130 and the hot air supplying pipe 240 for controlling the first connecting pipe 130 and the hot air supplying pipe 240 respectively.

The steam generating part 270 generates steam and supplies the steam into the cabinet dryer 200.

The steam generating part 270 may be provided in at least one of the washing machine 100 and the cabinet dryer.

Preferably, the steam generating part 270 is provided only in the cabinet dryer 200 so that the washing machine 100 may have almost the same configurations as conventional washing machines. Alternatively, the steam generating part 270 may be provided in the washing machine 100.

Also, the steam generating part 270 is connected with the keeping part 220 by a steam supplying pipe 280.

The steam generating part 270 includes a water chamber 271 for storing water therein to generate steam, a water supplying pipe 272 connected with the water chamber 271 for receiving water from the water chamber 271, a heat radiating part 273 having predetermined space for temporarily storing the water from the water supplying pipe 272 and a heating element 274 provided within the heat radiating part 273 for evaporating the stored water into steam.

Preferably, the steam generated by the steam generating part 270 is supplied into the washing machine 100, too.

For that, according to the preferred embodiments of the present invention a second connecting pipe 140 is further provided, which is branched from a portion of the steam supplying pipe 280 to be connected with the washing machine 100.

Also, a second air channel valve 182 is further provided at the portion, where the second connecting pope 140 is branched, for selectively opening/closing the portion.

Preferably, the second air channel valve 182 is a 3-way valve opening/closing the steam supplying pipe 280 and the second connecting pipe 140. Also, the second air channel valves 182 are each provided at the steam supplying pipe 280 and the second connecting pipe 140, and controlled respectively.

Preferably, a steam outlet of the second connecting pip 140 is connected with the second connecting pipe 130.

Next, the controller 300 will be described.

The controller 300 according to the present invention controls the operations of the washing machine 100 and the cabinet dryer 200.

The controller 300 may be provided in at least one of the washing machine 100 and the cabinet dryer 200, but according the preferred embodiments of the present invention the controller 300 is preferably provided only in the washing machine 100.

when the controller 300 is provided in both of the washing machine 100 and the cabinet dryer 200, the two controllers 300 may be connected by a data cable (not shown) for exchanging information.

The controller 300 may control the washing machine 100 and the cabinet dryer 200, or may control the washing machine 100 and the cabinet dryer 200 to communicate each other.

Figure 3:
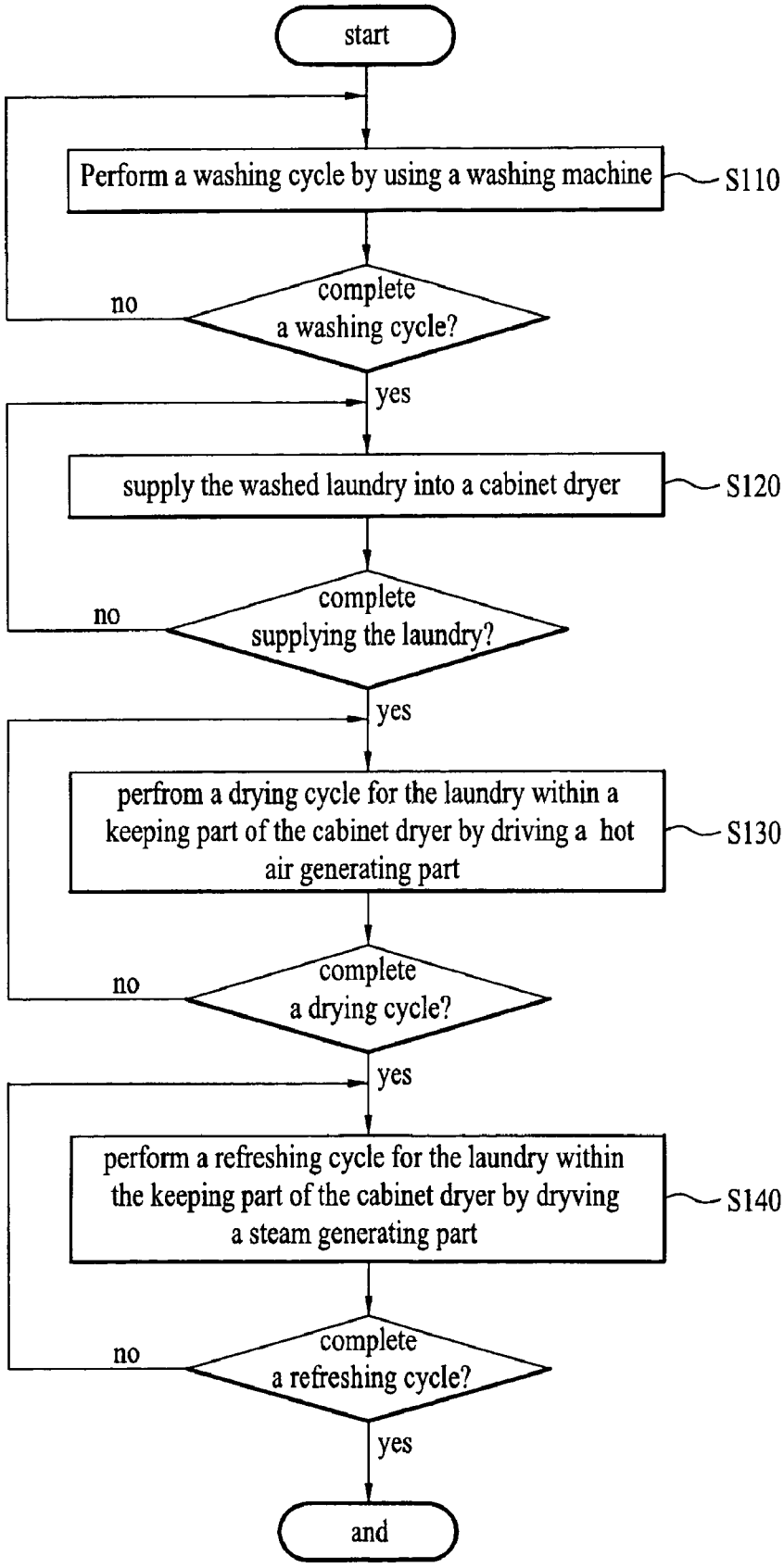
FIG. 3 is a flow chart schematically illustrating an operation control process of a first embodiment of the present invention.

Referring to a flow chart of FIG. 3, an operation controlling process according to a first embodiment of the present invention will be described.

First, a controller 300 controls a washing machine 100 to perform a washing cycle, once a washing cycle is selected (S110).

The washing cycle may be performed by not only a conventional method through rotating/agitating a drum, but also the other various methods.

Once the washing cycle is completed by the series of the processes described above, the controller 300 request the washed laundry to be supplied into the cabinet dryer 200 (S120).

A user is notified of the request for the laundry by trough a display window 310 by displaying the contents of the request. Alternatively, a user is notified of the request for the laundry through a beep signal or a voice guide.

Also, the controller 300 consistently identifies if the laundry is completely supplied into the cabinet dryer 200, as well as performing the request for the laundry.

At that time, if it is completed to supply the laundry into the cabinet dryer 200 may be identified through various ways.

For example, it may be identified through the user's direct operation of the controller 300 such as selecting a particular button, or through sensing a weight of the laundry within the washing machine 100, or through identifying a state of the door 230 operations.

Once the controller 300 identifies the completion of supplying the laundry by one of the above ways, the controller 300 controls a hot air supplying part 250 to perform a drying cycle for the laundry within the keeping part 220 (S130).

That is, after heating air within the hot air supplying pipe 240 by operating a drying heater 251 of the hot air supplying part 250, a fan 252 drives to let the hot air flow along the hot air supplying pipe 240.

At that time, the controller 300 controls a first air channel 181 to supply the hot air only into the keeping part 220 of the cabinet dryer 200.

That is, the hot air supplying pipe 240 is opened, and the first connecting pipe 130 is closed.

Once the above drying cycle is completed, the controller 300 drives the steam generating part 270 to perform a refreshing cycle for the dried laundry (S140).

The refreshing cycle is a series of operations supplying high temperature steam into the keeping part 220 of the cabinet dryer 200 for sterilizing the laundry and smoothing out wrinkles of the laundry.

For the refreshing cycle, the heating element 274 of the steam generating part 270 is operated and water supplied into the heat radiating part 273 is evaporated into steam, and then the steam is supplied into the keeping part 220.

At that time, the steam is supplied through the steam supplying pipe 280 communicating with the keeping part 220.

During the refreshing cycle, the controller 300 controls the second air channel valve 182 for letting the steam supplied into the keeping part 220 of the cabinet dryer 200.

That is, the steam supplying pipe 280 is opened, and the second connecting pipe 140 is closed.

Preferably, the refreshing cycle is repeatedly performed every predetermined time period when a drying cycle is completed.

That is for the laundry of the keeping part 220 to be refreshed as well as sterilized all the time, even if the laundry is kept within the cabinet dryer 200.

Thus, the entire washing, drying and refreshing cycle for the laundry is completed by the series of the processes of the preferred embodiments of the present invention described above.

On the other hand, when the washing cycle is performed in high temperature environments, great washing efficiency may be gained. That is, dirt is separated from the laundry more smoothly at a temperature approximately between 50~70° C.

Thus, a second embodiment of the present invention presents that an inside of the drum 120 accomplishes high temperature environments.

Figure 4:
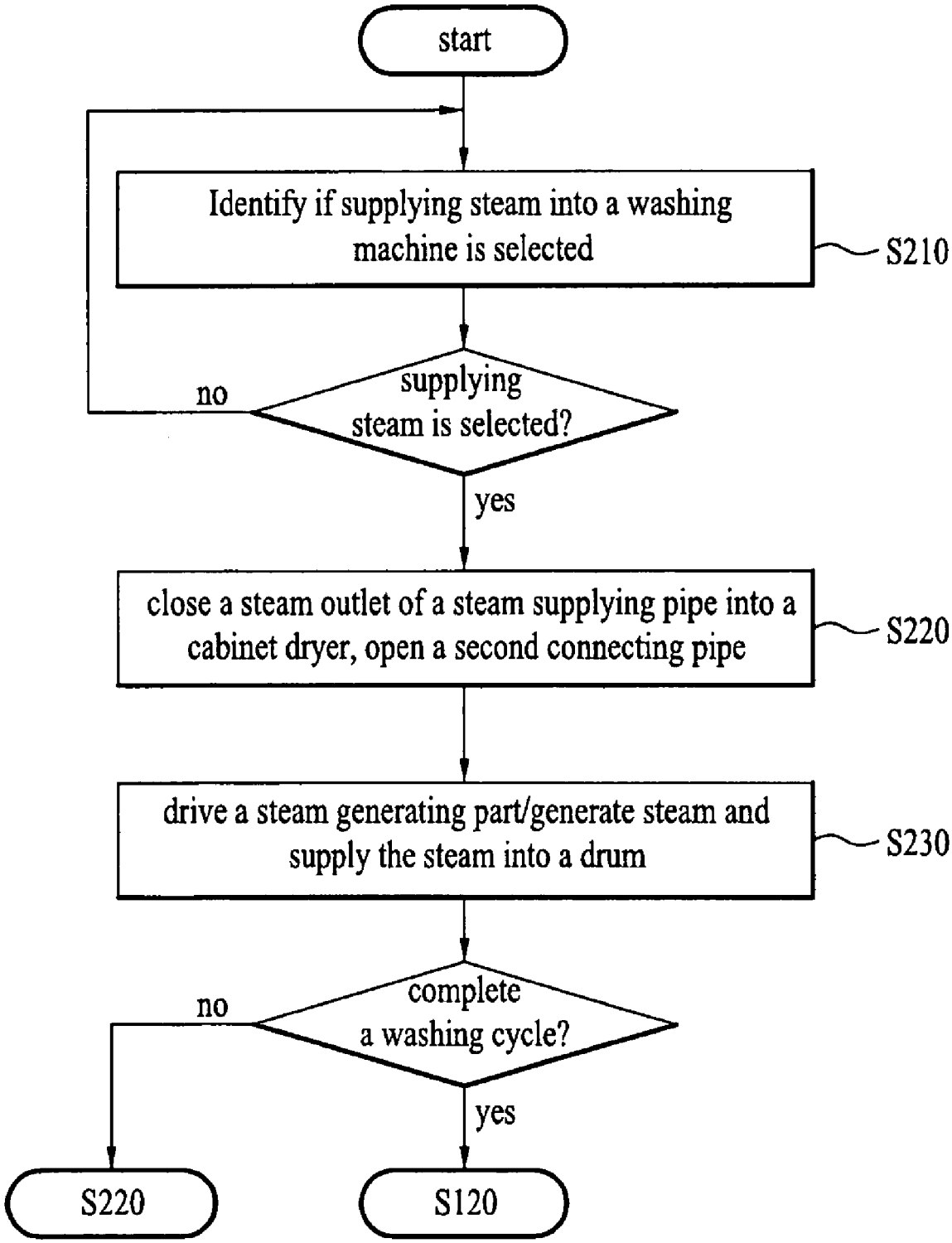
FIG. 4 is a flow chart schematically illustrating an operation control process of a second embodiment of the present invention.

Referring to a flow chart of FIG. 4, the second embodiment of the present invention will be described.

First, while or before performing the washing cycle the controller 300 identifies if the washing cycle is performed at a high temperature, that is, if steam is supplied into the washing machine 100 (S120).

Since there is textile such as cotton or linen which should not be washed at a high temperature, it is identified if the washing cycle is performed at a high temperature.

Preferably, a user selects if the washing cycle is performed at a high temperature or not.

Hence, once the high temperature washing cycle is selected, the controller 300 controls the second air channel valve 182 to close a steam outlet of the steam supplying pipe 280 into the cabinet dryer 200, and to open a pipe way of the second connecting pipe 140 (S220).

That is for supplying steam only into the washing machine 100.

Hence, the controller 300 controls the steam generating part 270 of the cabinet dryer 200 to generating steam and to supply the steam into the washing machine 100 through the second connecting pipe 140 (S230).

At that time, since the steam at a high temperature makes the inside of the drum 120 receiving the steam to accomplish high temperature humid environments. Thereby, good washing efficiency may be gained.

Preferably, when the steam is supplied into the washing machine 100, the drum 120 is controlled to rotate for supplying the steam to the laundry uniformly.

On the other hand, an operation method according to a preferred third embodiment of the present invention presents further includes a step of supplying a high temperature steam into the drum 120 having the laundry therein, before a washing cycle of the washing machine 100.

That is for washing the laundry more smoothly.

Alternatively, before a washing cycle, washing water is supplied and the laundry may be soaked for a predetermined time period. However, for soaking the laundry, much amount of washing water is needed. Therefore, as presented in a third embodiment, it is preferred that steam is used to gain a soaking effect with a minimized amount of washing water.

Figure 5:
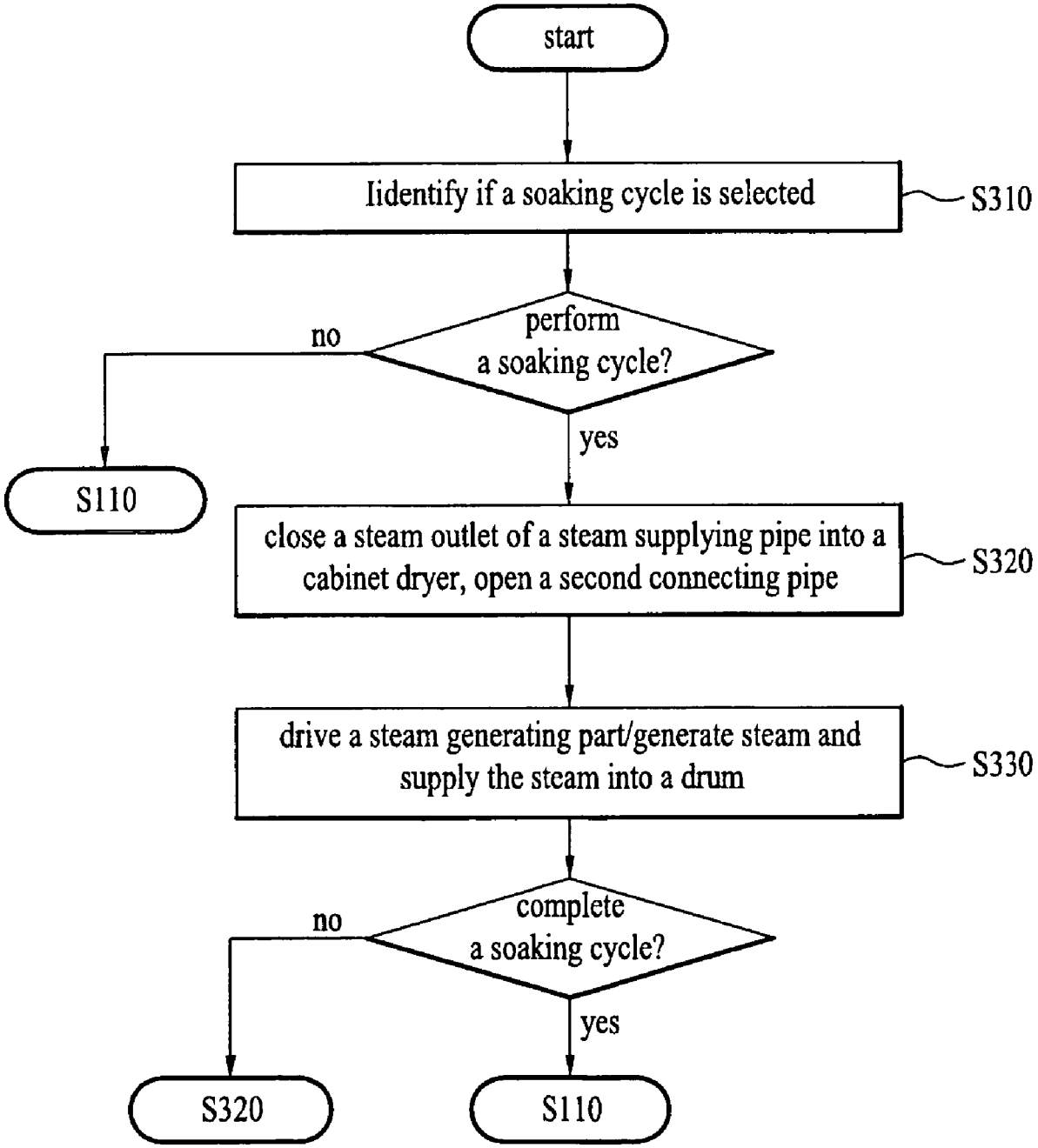
FIG. 5 is a flow chart schematically illustrating an operation control process of a third embodiment of the present invention.

Referring to a flow chart of FIG. 5, a process of a soaking cycle by using steam will be described.

First, the controller 300 identifies if the user selects a soaking cycle before a washing cycle (S310).

In case that the user selected the soaking cycle, the controller 300 controls the second air channel valve 182 to close a steam outlet of the steam supplying pipe 280 into the cabinet dryer 200, and to open the second connecting pipe 140 (S320).

Hence, the steam generating part 270 is controlled to generate steam and to supply the steam into the drum 120 of the washing machine 100 (S330).

Thus, the laundry within the drum 120 is dampened by the steam supplied into the drum 120, and maintains the dampened state for a predetermined time period for soaking the laundry.

Since the steam is high temperature, various kinds of dirt on the laundry are soaked more smoothly.

Also, in case that, steam is supplied into the washing machine 100, it is preferred but not necessary that the controller 300 controls the drum 120 of the washing machine 100 to rotate.

That is for supplying the steam to the laundry within the drum uniformly.

Thus, since a washing cycle is performed after a soaking cycle by the series of processes according to the third embodiment of the present invention, washing efficiency may be enhanced.

Each preferred embodiment of the present invention does not define that a washing, drying and refreshing cycle is performed respectively.

That is, a refreshing cycle of the cabinet dryer 200 may be also performed simultaneously during the washing cycle of the washing machine 100.

That is why the user may want a refreshing cycle for using water kept within the cabinet dryer 200 during the washing cycle of the washing machine 100.

Figure 6:
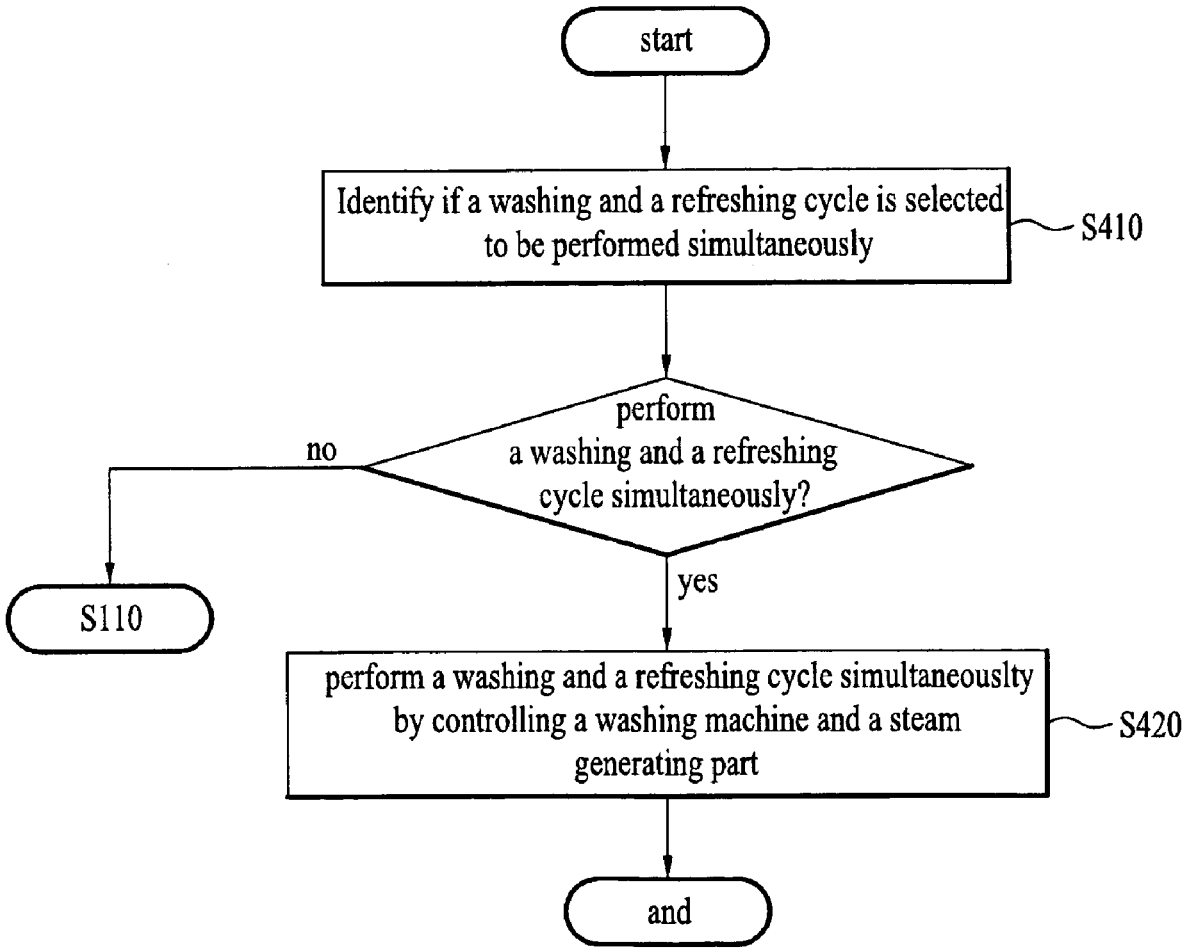
FIG. 6 is a flow chart schematically illustrating an operation control process of a fourth embodiment of the present invention.

Thus, the fourth embodiment of the present invention presents that a washing cycle of the washing machine 100 and a refreshing cycle of the cabinet dryer 200 may be performed at the same time, and that operation process will be described, referring to a flow chart of FIG. 6.

First, before or while performing a washing cycle of the washing machine 100, the controller 300 identifies if a refreshing cycle of the cabinet dryer 200 is selected (S410)

In case that the user selects a refreshing cycle to be performed simultaneously with a washing cycle of the washing machine 100, the controller 300 controls the steam generating part 270 to perform a refreshing cycle of the cabinet dryer 200 simultaneously (S420).

At that time, the controller 300 controls the second air channel valve 182 to supply steam only into the keeping part 220 of the cabinet dryer 200.

That is, the steam supplying pipe 280 is opened, and the second connecting pipe 140 is closed.

Thus, at the same time when the washing cycle is performed for the laundry within the washing machine 100, a refreshing cycle is performed for the laundry kept within the keeping part 220 of the cabinet dryer 200.

Alternatively, even in case that the washing cycle of the washing machine 100 and the refreshing cycle of the cabinet dryer 200 is performed simultaneously, high temperature steam may be supplied also into the washing machine 100 as necessary for washing the laundry more smoothly.

That is, when performing a washing and a refreshing cycle simultaneously, it is identified if hot steam is requested to be supplied into the washing machine 100. hence, in case that there is a request for supplying hot steam, the second air channel valve 182 is controlled to open the second connecting pipe 140.

In case that it is identified if supplying hot steam into the washing machine 100 is not requested, the second connecting pipe 140 maintains being closed.

On the other hand, there may be a problem that the laundry has severely tangled portions even after the washing cycle of the washing machine 100, if the laundry is not taken out for a long period of time.

For example, the user may be leave the laundry device for a long time even after washing and dehydrating is completed. Then, if the laundry is not taken out, each laundry dries under the condition of being tangled, thereby causing the laundry to have severe tangled portions.

Thus, an operation method according to a fifth embodiment of the present invention presents additional steps of supplying a predetermined amount of steam into the washing machine 100 in case that the laundry is not moved into the cabinet dryer 200 for a long period of time after a washing cycle. That is for preventing the tangled portions of the laundry.

Figure 7:
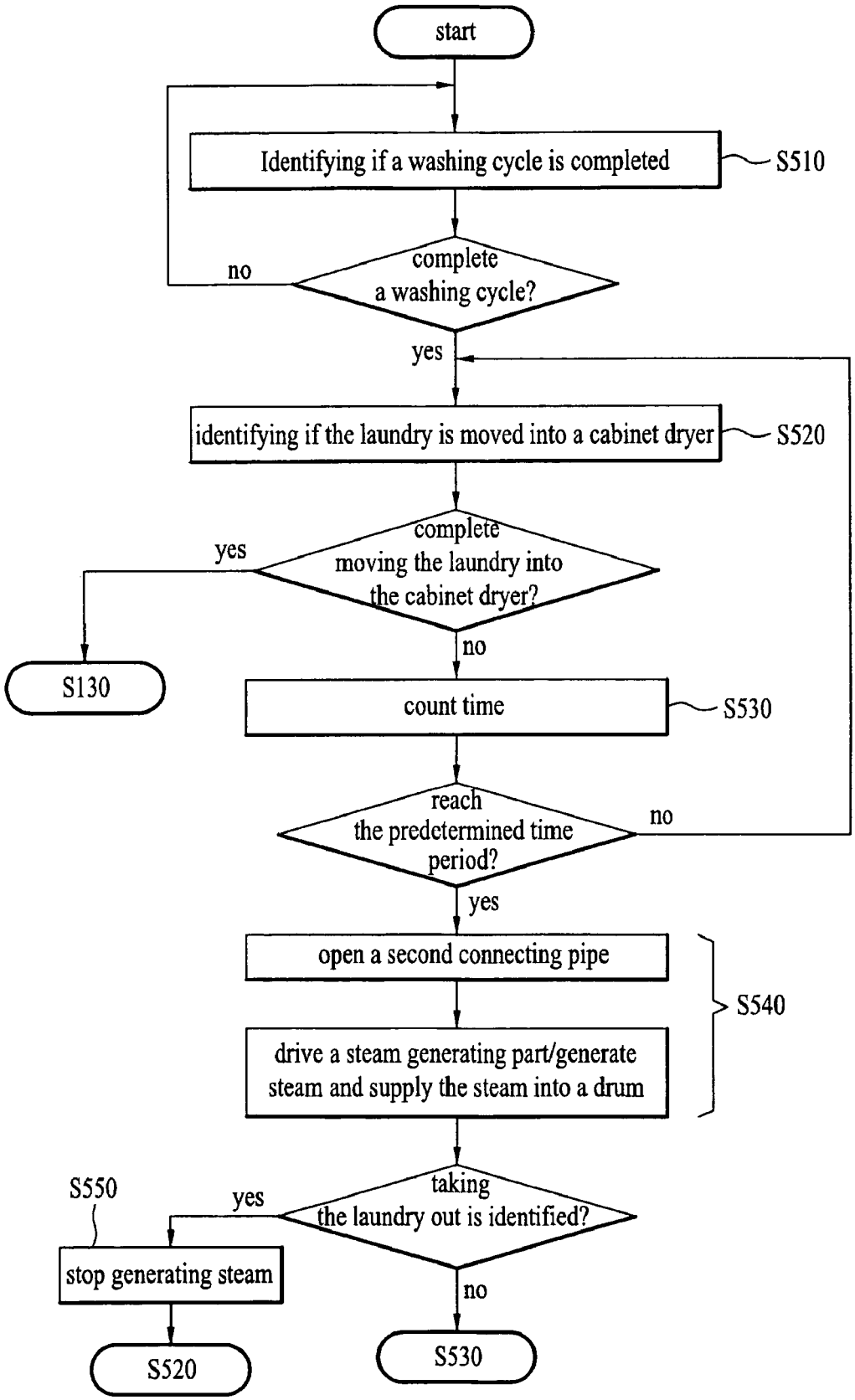
FIG. 7 is a flow chart schematically illustrating an operation control process of a fifth embodiment of the present invention.

Referring to a flow chart of FIG. 7, the operation method according to the fifth embodiment of the present invention will be described.

First, the controller 300 identifies if the washing cycle is completed (S510).

Hence, once the washing cycle is completed, the controller 300 identifies if the laundry is moved into the cabinet dryer 200 (S520).

At that time, in case that the laundry is moved into the cabinet dryer 200, a drying cycle by using the cabinet dryer 200 is performed as described in the first embodiment of the present invention.

Whereas, in case that the laundry is not moved into the cabinet dryer 200, the controller 300 counts the time when from the moment the washing cycle is completed to the time predetermined discretionally (S530).

Even when the predetermined time have passed, the laundry is not moved from the drum 120 of the washing machine 100, the controller 300 controls the second air channel valve 182 to open the second connecting pipe 140, and controls the steam generating part 270 to consistently supply steam into the washing machine 100 (S540).

At that time, the controller 300 controls the drum 120 of the washing machine 100 to rotate consistently for supplying steam to the entire laundry uniformly as well as to disentangle the tangled portions, thereby minimizing the tangled portions of the laundry.

Preferably, the steam is consistently supplied into the washing machine 100 before the user selects to take out the laundry, or repeatedly supplied during the predetermined time period before the user selects to supply steam into the washing machine 100.

Once the user selects to take the laundry out while supplying steam into the washing machine 100, the step of generating steam (S550) is stopped, and re-identifies if the laundry is moved into the cabinet dryer 200 (S520).

Preferably, a series of steps supplying steam into the washing machine 100 is performed again, once the predetermined time period have passed in a state of not moving the laundry into the cabinet dryer 200.

Therefore, the operation method of the laundry device according to the each embodiments of the present invention has an advantageous industrial effect that washing and refreshing the laundry is possible.

Furthermore, the operation method of the laundry device according to the third embodiments of the present invention has another advantageous industrial effect of enhancing washing efficiency, because washing is performed under the high temperature environments through supplying hot air in a washing cycle.

Still further, the operation method of the laundry device according to the third embodiment of the present invention has another advantageous industrial effect of enhanced washing efficiency, because soaking the laundry is possible.

Still further, the operation method of the laundry device according to the fourth embodiment of the present invention has another advantageous industrial effect that it is possible to perform a drying or a refreshing cycle using the cabinet dryer at the same time while performing a washing cycle by using the washing machine 100. Thereby the time for the entire washing mat be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An operation method of a laundry device comprising:

a first step of performing a washing cycle by using a washing machine comprising:

identifying if a user selects a refreshing cycle to be performed simultaneously while using a cabinet dryer, performing the refreshing cycle by supplying steam, generated by driving a steam generating part of the cabinet dryer, into the cabinet dryer, and identifying if steam into the washing machine is selected together with the refreshing cycle;

a second step of moving the laundry into the cabinet dryer, which selectively receives steam together with the washing machine; and a third step of performing a drying cycle by supplying hot air into the cabinet dryer.

2. The operation method of the laundry device of claim 1, further comprising a step of consistently identifying if moving the laundry into the cabinet dryer is completed, before the third step.

3. The operation method of the laundry device of claim 2, wherein the step of identifying if moving the laundry is completed is performed the by user's direct operation of a controller.

4. The operation method of the laundry device of claim 2, wherein the step of identifying if moving the laundry is completed is performed by sensing a weight of the laundry within the washing machine.

5. The operation method of the laundry device of claim 2, wherein the step of identifying if moving the laundry is completed is performed by identifying if a door of the cabinet dryer is opened or closed.

6. The operation method of the laundry device of claim 1, further comprising a step of performing the refreshing cycle, which refreshes the laundry, by driving the steam generating part after the third step of performing a drying cycle is completed.

7. The operation method of the laundry device of claim 6, wherein the step of performing the refreshing cycle is repeatedly performed at every predetermined time period from the time when the third step of performing a drying cycle is completed.

8. The operation method of the laundry device of claim 1, wherein the first step further comprises a step of supplying steam into the washing machine after driving the steam generating part to generate steam.

9. The operation method of the laundry device of claim 8, wherein the step of supplying steam into the washing machine is performed together with the first step of performing a washing cycle by using the washing machine.

10. The operation method of the laundry device of claim 9, wherein the step of supplying steam into the washing machine comprises a step of rotating a drum.

11. The operation method of the laundry device of claim 8, wherein the step of supplying steam into the washing machine is performed before the first step of performing a washing cycle by using the washing machine.

12. The operation method of the laundry device of claim 11, wherein the step of supplying steam into the washing machine comprises a step of rotating the drum of the washing machine.

13. The operation method of the laundry device of claim 1, wherein the first step further comprises a step of opening a pipe having the steam flown therein, which is connected to the washing machine.

14. An operation method of a laundry device comprising:

a first step of performing a washing cycle by using a washing machine;

a second step of moving the laundry into a cabinet dryer which selectively receives steam together with the washing machine;

a third step of performing a drying cycle by supplying hot air into the cabinet dryer; and a step of counting time from the time when the first step of performing a washing cycle is completed, wherein the step of counting time comprises a step of supplying steam by driving the steam generating part, in case that the counting time is more than a predetermined time period.

15. The operation method of the laundry device of claim 14, wherein the step of counting time further comprises a step of rotating the drum of the washing machine while supplying steam into the washing machine.

* * * * *